United States Patent [19]

McCurdy

[11] Patent Number: 4,685,360

[45] Date of Patent: Aug. 11, 1987

[54] DRAWING HOLDER NUT WRENCH

[76] Inventor: Gaylord W. McCurdy, 14060 W. 25th Pl., Golden, Colo. 80401

[21] Appl. No.: 703,141

[22] Filed: Feb. 19, 1985

[51] Int. Cl.[4] ..... B25B 13/02

[52] U.S. Cl. ..... 81/119; 81/121.1; 81/125.1

[58] Field of Search ..... 81/119, 176.1, 120, 81/176.15, 121.4, 176.2, 176.3, 125.1, 436, 461, 901, 124.1–124.7, 186; 7/138, 169; D8/17

[56] References Cited

U.S. PATENT DOCUMENTS

D. 268,473 4/1983 Rust ..... D8/17
1,471,277 10/1923 Parker ..... 81/119
4,392,264 7/1983 Booe, Jr. ..... 7/138

FOREIGN PATENT DOCUMENTS 968582 11/1950 France ..... 7/437

*Primary Examiner*—Robert P. Olszewski
*Assistant Examiner*—Maurina Rachuba
*Attorney, Agent, or Firm*—Joseph C. Herring

[57] ABSTRACT

A drawing holder wrench is made up of a plate having an elongated hexagonal and/or wing nut openings adjacent the ends. The wrench has bends traversing the length of and in the center of the openings to reduce the ability of the wrench to slip under the nut as it moves away from the drawing holder. The bends are preferably 20 to 30 degrees.

10 Claims, 3 Drawing Figures

DRAWING HOLDER NUT WRENCH

BACKGROUND OF THE INVENTION

Many simple wrenches have been invented to fit particular objects which must be turned for some purpose. The following patents disclose some of these wrenches.

U.S. Pat. No. Des. 248,613 issued to Thomas Pace teaches a gas meter valve wrench having a handle cover on one end and a lateral bend at the other. Within the offset portion is the opening needed to turn the meter nut.

U.S. Pat. No. Des. 260,473 issued to B. W. Rust teaches a drawing holder nut wrench having an elongated hexagonal opening on one end of a bar and a wing nut shaped opening on the other. The end portions are parallel with two intermediate equal and opposite bends causing the ends to be offset in an open "S" form.

U.S. Pat. No. Des. 264,796 issued to S. E. Frick et al teaches a drawing holder nut wrench having an elongated hexagonal opening at one end with a bend medial to and near the elongated hexagonal opening.

U.S. Pat. No. 4,368,596 issued to J. V. Dam, Jr. teaches a hose clamp tool made up of a flat rectangular plate and having a key hole aperture.

The present invention solves the problem faced but not solved by those designing wrenches for drawing holder nuts. Thus, when the nut is twisted so that it moves away from the body of the drawing holder, a space is formed under the nut into which the present wrenches often slip. The wrench then must be repositioned and handled carefully to prevent it from again slipping below the nut.

SUMMARY OF THE INVENTION

The drawing holder wrench of this invention is formed by a plate having an elongated hexagonal opening adjacent one end. The opening is sufficiently large to receive the elongated hexagonal nuts used with most drawing holders. The other end can have an opening for the more familiar wing nuts with two flat "wings" attached to a central post with a greater diameter. These new wrenches have a bend substantially at the mid-point of each opening sufficient to effectively increase the effective depth of the wrench and prevent it from slipping below the bottom edge of the nut when the twisting of the nut moves it away from the drawing holder a distance greater than the actual thickness of the wrench. The effective depth increase can be provided by a single bend causing a discrete angle at the opening mid-point, multiple small angles or a continuous curvature.

GENERAL DESCRIPTION OF THE PREFERRED EMBODIMENTS OF THE INVENTION

Figure 1:
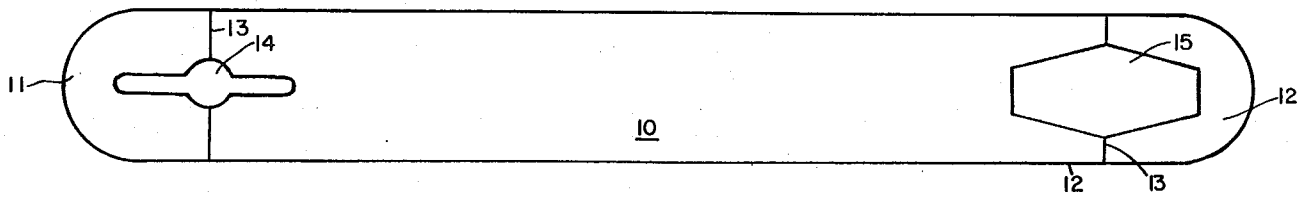
FIG. 1 is a top view of one of the embodiments of the invention having an elongated hexagonal opening at one end and a typical opening for the standard wing nut at the other.

The wrench of FIG. 1 is in the form of a flat plate shaped like a tongue depresser used by medical doctors. It differs, however, by having end portions 11 and 12 separated from the main body of plate 10 by bends 13 which substantially intersect the wing nut shaped opening 14 and the elongated hexagonal opening 15. In this embodiment, bends 13 are in opposite directions and are sharply angled at about 20°–30° from the horizontal.

Figure 2:
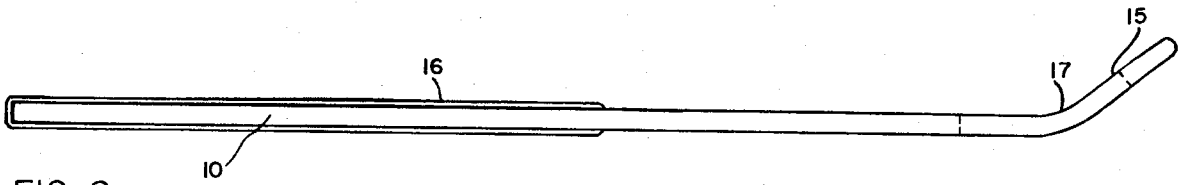
FIG. 2 is a side view of a wrench having only the elongated hexagonal opening at one end, and on the other end, a handle cover of polymeric material.

FIG. 2 is a side view of an embodiiment of the invention having a molded handle 16 on one end and a curve 17 on the other along the length of hexagonal opening 15.

Figure 3:
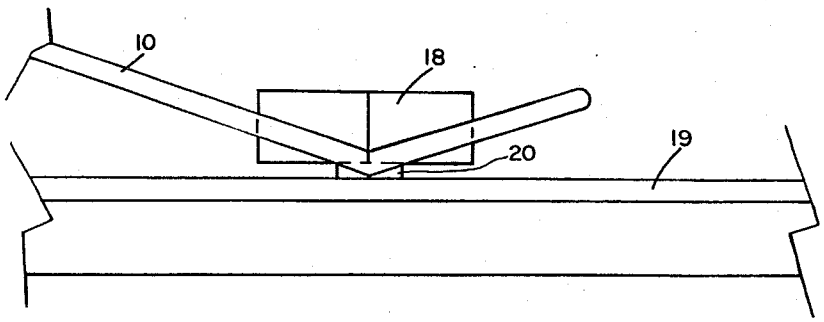
FIG. 3 is a side view of a wrench is use.

FIG. 3 depicts an intermediate portion 10, an end portion 12 of a wrench surrounding, at opening 15 an elongated hexagonal nut 18. Nut 18 is connected to drawing holder 19 by neck 20. The drawing indicates readily how the effectiveness thickness of the wrench is increased by the bend 13 and how the preferred used of the wrench at an angle prevents the wrench from slipping below elongated hexagonal nut 18 when twisting moves nut 18 away from drawing holder 19.

GENERAL DESCRIPTION OF THE INVENTION

Wrenches of this invention can be of any length but will normally have a length ranging from 6" to 10" and a thickness ranging from about $\frac{1}{8}$" to about $\frac{1}{4}$". This invention allows the wrenches to be made of a much thinner stock and to be stamped, in many instances, instead of machined. These benefits make the tool practical for wide spread usage.

The wrench can be made of a metal; for example, brass, aluminum, or iron. It can also be made of a plastic material such as nylon or polyformal. The plastic material can be reinforced with glass fibers, metal wire fibers, carbon filament and other reinforcement materials. The wrench can be bare, anodized, stamped from vinyl covered metal, or entirely coated later.

Handle cover 16 is "molded." Molded, as used herein, means that the handle cover can be made by dipping a cold wrench into a hot polymer melt and withdrawing the wrench, by dipping a hot wrench in a fluidized bed of cold polymer particles by slipping a molded handle over the wrench, or other means known to the art. The handle 16 can be of rubber, or any of the thermoplastic resins used to coat electrical tools; for example, wire cutters, wire pliers, and the like or other materials, i.e., melamine.

While the wrench is preferably of a flat untapered material, it can be tapered horizontally or longitudinally and/or can have any of a variety of shapes; for example, the shapes of the listed prior art patents. Of course, bend 13 would be used instead of the lateral bend seen in U.S. Pat. No. Des. 248,613. The external corners of the wrenches of this invention are preferably rounded and all other edges are preferably beveled.

Now having described by invention, what I claim is:

1. In a drawing holder nut wrench, the improvement comprising a straight flat plate having one or more elongated openings adapted for engaging drawing holder nuts, said plate having bends in the plate substantially centered between the ends of each such openings and perpendicular to the lengths of such openings.

2. The wrench of claim 1 with an opening at each end of the wrench.

3. The wrench of claim 1 wherein the at least one opening is of an elongated hexagonal shape.

4. The wrench of claim 1 wherein the at least one opening is of an wing nut shape.

5. The wrench of claim 1 wherein one end of the wrench has a handle cover.

6. The wrench of claim 1 wherein the wrench is tapered in at least one direction.

7. The wrench of claim 1 wherein the wrench is shaped like a tongue depresser.

8. The wrench of claim 1 wherein the wrench is made of a metal.

9. The wrench of claim 1 wherein the wrench is made of a plastic material.

10. In a drawing holder nut wrench, the improvement comprising a straight, flat plate having one or more elongated openings adapted for engaging drawing holder nuts, said plate having 20–30 degree bends in the plate substantially centered between the ends of each such opening and perpendicular to the lengths of such openings.

* * * * *